United States Patent [19]

Abele et al.

[11] 4,124,397

[45] Nov. 7, 1978

[54] PROCESS FOR HARDENING PHOTOGRAPHIC SILVER HALIDE EMULSIONS

[75] Inventors: Werner Abele; Wolfgang Pistor, both of Neu-Isenburg; Manfred Schmidt, Dietzenbach-Steinberg; Harry O. Smith, Neu-Isenburg; Nils Spannhake, Grevenbroich, all of Germany

[73] Assignee: E. I. Du Pont de Nemours and Company, Wilmington, Del.

[21] Appl. No.: 836,840

[22] Filed: Sep. 26, 1977

[30] Foreign Application Priority Data

Oct. 26, 1976 [DE] Fed. Rep. of Germany ..... 2648286

[51] Int. Cl.[2] ..... G03C 1/34; G03C 1/30

[52] U.S. Cl. ..... 96/109; 96/111

[58] Field of Search ..... 96/111, 109

[56] References Cited

U.S. PATENT DOCUMENTS

| | | | |
|---|---|---|---|
| 3,232,764 | 2/1966 | Allen et al. | 96/111 |
| 3,342,605 | 9/1967 | McCrossen et al. | 96/111 |

FOREIGN PATENT DOCUMENTS

| | | | |
|---|---|---|---|
| 606,528 | 12/1934 | Fed. Rep. of Germany | 96/109 |

*Primary Examiner*—Won H. Louie, Jr.

[57] ABSTRACT

A process for hardening photographic gelatino-silver halide emulsions with glutaraldehyde or substituted glutaraldehydes.

6 Claims, 1 Drawing Figure

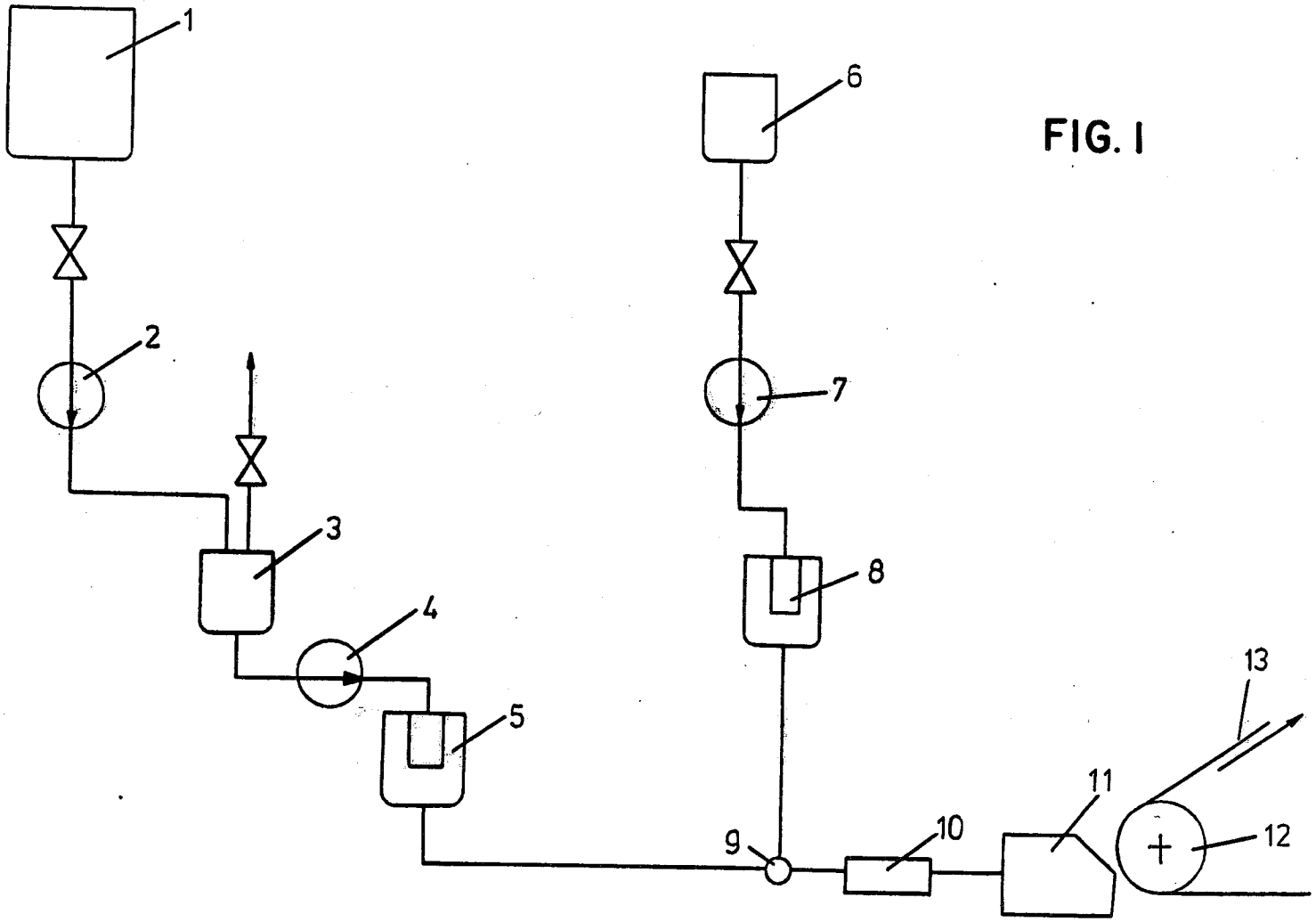
FIG. I

PROCESS FOR HARDENING PHOTOGRAPHIC SILVER HALIDE EMULSIONS

BACKGROUND OF THE INVENTION

It is known that dialdehydes are effective hardeners when used in photographic gelatino-silver halide emulsions. U.S. Pat. No. 3,232,764 discloses hardening photographic silver halide emulsions with dialdehydes whose aldehyde groups are separated by an unbranched chain of 2–3 carbon atoms, preferably glutaraldehyde and its derivatives. These compounds demonstrate excellent hardening properties, especially in view of the mechanical strength and temperature stability attained.

It is known, however, that aldehyde hardeners sometimes exhibit an undesirable influence on the sensitometric properties of photographic emulsions. Therefore, in actual practice, it is necessary to reach a compromise between sufficient hardening and the desired sensitometric properties. Generally, the process is carried out in such a way that the concentration of the hardener is as low as possible to maintain the desired mechanical strength and temperature stability of the films. For example, U.S. Pat. No. 3,232,764 states that to attain the desired hardening effect it is necessary to use the dialdehyde compounds in a concentration of at least 0.5 to 25% by weight of the gelatin content. A decrease of the concentration is not possible, because, as seen from Example 3 of the patent, with lesser amounts of hardener there is insufficient hardening for all practical purposes.

It is also known to add hardeners at any point in time during the preparation of the photographic gelatino-silver halide emulsions. There are also known processes and apparatus to accomplish this, especially shortly before coating, to prevent any premature secondary reactions of the hardener with any of the other emulsion ingredients.

It is the object of the invention to give an improved process for hardening photographic gelatino-silver halide emulsions using glutaraldehyde or substituted glutaraldehyde, whereby a combination of good hardening effects and improved sensitometric properties can be attained.

SUMMARY OF THE INVENTION

The invention is a process for hardening of photographic gelatino-silver halide emulsions using glutaraldehyde or substituted glutaraldehydes as hardeners, characterized in that the hardener is continuously added to the emulsion stream between the supply vessel and the coater, and immediately prior to the coating process, and that the concentration of the hardener is less than 0.5% by weight, based on the weight of the total gelatin content.

DETAILED DESCRIPTION OF THE INVENTION

The hardener can be added to the coating solution using a process, as, for example, shown in the FIGURE. The coating solution passes to a deaerating vessel 3 from a supply vessel 1 by means of a pump 2. A metering pump 4 forces the coating solution through a filter 5. At point 9 of the continuous flow of the coating solution, the hardener is continuously added and is fed through a static mixing zone 10 to coater 11, where it is applied to film base 13 which is moving over roller 12. The hardener is taken as an aqueous solution from a supply vessel 6 and is added with the help of a metering pump 7, through a filter 8, at point of mixing 9.

Suitable dialdehydes which may be used in the process of the invention are, for example:

Glutaraldehyde
2-methyl glutaraldehyde
3-methyl glutaraldehyde
2,2'-dimethyl glutaraldehyde
2-n-butoxy glutaraldehyde
3-n-butoxy glutaraldehyde
2-methyl-3-ethoxy glutaraldehyde
2-ethyl-3-ethoxy glutaraldehyde In order to achieve the desired advantages using the process of the invention, it is sufficient that the dialdehyde hardener is used in concentrations of less than 0.5% by weight, based on the weight of the gelatin. The preferred range of concentration is 0.05 to 0.3%. The admixture is added to the emulsion coating solution. However, the hardener can also be added to other layers contiguous to the emulsion layer.

It is also possible to partially replace the specific hardener, according to the invention, with other known emulsion hardening agents, e.g., formaldehyde; this can also be added to the layers contiguous to the emulsion layer, and, if necessary, by any of the conventional processes.

It is surprising that an improvement of the sensitometric properties can be achieved using the described process. As known, the admixture of the hardener at a later point in time prevents premature or secondary reactions, so that the quantity of hardener added is available to complete the desired hardening effect in the photographic layer. Those skilled in the art could expect that the increased hardening of the photographic layer would be accompanied by a deterioration of sensitometric properties. Surprisingly, there is considerable improvement of the sensitometric values; simultaneously the favorable hardening properties, such as quick hardening and no after-hardening, are completely retained.

Surprisingly, this same improvement of sensitometric properties is not achieved with other hardeners containing aldehyde groups. For example, glyoxal or succinaldehyde, which according to U.S. Pat. No. 3,232,764, are equivalent to glutaraldehyde, do not show the described effects.

The process of the invention is suitable for hardening all usual gelatin-containing light-sensitive emulsions such as silver chloride, silver bromide, silver chloride bromide or silver bromide iodide emulsions. The emulsions can contain the usual additives, such as optical sensitizers, coating additives, chemical sensitizers and stabilizers. According to a preferred embodiment, aliphatic or aromatic sulfinic acids or their water-soluble salts, known from German Pat. No. 606,528, are added as stabilizers to the emulsions. Especially favorable results are obtained in regard to sensitivity and fogging when hardening is carried out in the presence of sulfinic acids, especially benzene sulfinic acids or toluene sulfinic acids and/or their salts. This class of stabilizers is eminently suited for preventing fog formation without impairing the higher sensitivity achieved by the hardening process of the invention. Sulfinic acids can be added in concentrations of 0.5–15 g, preferably 1–6 g/mol silver halide, at any point in time after the preparation and washing of the silver halide emulsion.

The process of the invention is described more fully, and its effect is demonstrated by the following examples.

The photographic speed given in the tables has been measured at a density of 1.0 above fog and has been expressed in relation to the speed of the control emulsion (= 100) in each series.

EXAMPLE 1

A highly sensitive, stabilized, silver bromide iodide emulsion was prepared with approximately 2 mol-% AgI, and contained 5% by weight gelatin and 10% by weight silver halide. This emulsion was divided into three parts. To part A, which was in a supply vessel, was added glutaraldehyde in the form of an aqueous solution and in an amount of about 0.5% by weight, based on the weight of gelatin. Part B was handled likewise; however, only 0.25% by weight glutaraldehyde was added. For part C, likewise, 0.25% by weight glutaraldehyde was continuously added, according to the invention, to the emulsion stream between the supply vessel and the coater.

Emulsions of the three parts were coated, using conventional processes, on to a polyester film base and were dried. The film samples so obtained were exposed in a conventional manner and were processed in a developer having the following composition:

| | |
|---|---|
| Hydroquinone | 30 g |
| 1-phenyl-3-pyrazolidone | 1 g |
| $Na_2SO_3$, (anhydrous) | 60 g |
| KOH | 23 g |
| $NaBO_2 \cdot 4 H_2O$ | 20 g |
| KBr | 4 g |
| 1-phenyl-5-mercaptotetrazole | 0.015 g |
| water to | 1 liter |

After fixing and drying, the evaluation of the three samples indicated the following results:

| Sample | Relative Speed (%) | Fog | Melting Point (4 weeks) ° C. | Maximum Optical Density | Covering Power |
|---|---|---|---|---|---|
| A | 100 | 0.17 | >100 | 3.1 | 0.36 |
| B | 112 | 0.11 | 64 | 3.4 | 0.39 |
| C | 126 | 0.11 | >100 | 3.6 | 0.42 |

(The covering power values are indicated as: optical density per g silver/$m^2$ of film. The melting points are measured in water.)

In addition to the improvement of sensitometric properties, a favorable increase in the rate of the hardening reaction is observed. As shown in subsequent Example 2, complete hardening is achieved with considerably less hardener and, as desired, at an earlier point in time.

EXAMPLE 2

An emulsion prepared as in Example 1 was divided into two parts and was hardened with 0.25% glutaraldehyde each. In Sample A, the glutaraldehyde was added to the coating solution in the supply vessel; with Sample B, the hardener was added continuously to the coating solution between the supply vessel and the coater. The two emulsions were coated as described in Example 1 and melting point determinations were carried out with the film samples so obtained. The results appear in the following table, and show that it is possible to achieve more hardening (as measured by emulsion melting point) using the process of this invention. Additionally, relative speed values of the sample representing this invention (Sample B) appear to be more stable on aging.

| | FILM CHARACTERISTICS ON AGING | | | | | | | | | | | | | | | | | |
|---|---|---|---|---|---|---|---|---|---|---|---|---|---|---|---|---|---|---|
| | FRESH | | | 1 DAY | | | 7 DAYS | | | 4 WEEKS | | | 3 MONTHS | | | 6 MONTHS | | |
| Sample | Rel. Spd. (%) | Fog | M.P. (° C.) | Rel. Spd. (%) | Fog | M.P. (° C.) | Rel. Spd. (%) | Fog | M.P. (° C.) | Rel. Spd. (%) | Fog | M.P. (° C.) | Rel. Spd. (%) | Fog | M.P. (° C.) | Rel. Spd. (%) | Fog | m.p. (° C.) |
| A Control | 100 | .12 | 35 | 104 | .12 | 38 | 110 | .12 | 41 | 98 | .13 | 48 | 95 | .13 | 48 | 92 | .14 | 50 |
| 3 | 112 | .12 | 58 | 112 | .12 | 58 | 115 | .13 | 68 | 111 | .13 | 71 | 110 | .14 | 73 | 110 | .14 | 73 |

The melting points were measured in 0.1N NaOH

EXAMPLE 3

An emulsion prepared as in Example 1 was divided into two parts. To part A, in a suitable supply vessel, was added 0.15% glyoxal as aqueous solution, in reference to total gelatin. To part B, however, the same glyoxal quantity was added in a manner according to the invention. Both emulsions were coated and dried as described in Example 1. Evaluation indicated the following results:

| Sample | Emulsion Melting Point in ° C. after 7 days | Relative Speed (%) | Fog |
|---|---|---|---|
| A | 65 | 100 | 0.10 |
| B | 67 | 102 | 0.12 |

As seen, when using glyoxal as the hardener there was practically no improvement of the sensitometric properties.

EXAMPLE 4

An emulsion prepared as in Example 1 was divided into two parts. Part A was hardened using 0.2% succinaldehyde, part B with 0.2% glutaraldehyde. The admixture of the hardener in both instances was according to the invention. Both emulsions were coated and dried as described in Example 1. Evaluation indicated the following results:

| SENSITOMETRY | | | | |
|---|---|---|---|---|
| Sample | Hardener Used | Rel. Spd. (%) | Fog | Emulsion Melting Point (° C.) |
| A | Succinaldehyde | 100 | .07 | 62 |
| B | Glutaraldehyde | 123 | .06 | 75 |

Thus, no improvement of sensitometric properties occurred using succinaldehyde, whereas the improvement in hardeness of the sample prepared using glutaraldehyde and following the teachings of this invention is obvious from the above results.

EXAMPLE 5

An emulsion was prepared as in Example 1 and was divided into two parts. Shortly before coating, benzene sulfinic acid (4 g./mole of silver halide) was added to one part. Both parts were then hardened with 0.2% glutaraldehyde and coated as taught in Example 1. Evaluation of samples from these dried coatings gave the following results:

| Sample | Rel. Spd. (%) | Fog | Dmax | Covering Power | Melting Point After 7 Days (° C.) |
|---|---|---|---|---|---|
| A — no benzene sulfinic acid (BSA) | 126 | 0.11 | 3.6 | 0.42 | >100 |
| B — with BSA | 126 | 0.02 | 3.8 | 0.44 | >100 |

The use of the sulfinic acid is apparent from the fog, Dmax and covering power results.

We claim:

1. A process for the hardening of a photographic gelatino-silver halide emulsion using glutaraldehyde or a substituted glutaraldehyde as the hardener, characterized in that (1) the hardener is continuously added to, and mixed with, a stream of the emulsion at a point between the supply vessel in which the emulsion stream originates, and a coater, and immediately before coating, and (2) the hardener is added in a concentration of less than 0.5% by weight, based on the weight of total gelatin in the emulsion stream.

2. The process of claim 1 wherein the concentration of the hardener is between 0.05 and 0.30% by weight, based on the weight of total gelatin in the emulsion stream.

3. The process of claim 1 wherein an aliphatic or aromatic sulfinic acid, or a water-soluble salt of said acid, is added to the photographic gelatino-silver halide emulsion prior to hardening, and in an amount sufficient to prevent fog formation.

4. The process of claim 1 wherein benzene sulfinic acid, or a water-soluble salt thereof, is added to the emulsion prior to hardening, and in an amount sufficient to prevent fog formation.

5. The process of claim 6 wherein said sulfinic acid, or water-soluble salt thereof, is added in a concentration of 0.5 to 15 g per mole of silver halide.

6. The process of claim 4 wherein said sulfinic acid, or water-soluble salt thereof, is added in concentration of 0.5 to 15g per mole of silver halide.

* * * * *